US006921204B2

(12) United States Patent
Edwards et al.

(10) Patent No.: US 6,921,204 B2
(45) Date of Patent: Jul. 26, 2005

(54) INTERNAL BRACE FOR A STANDUP FLEXIBLE CONTAINER

(75) Inventors: Simon P. Edwards, Irvine, CA (US); Benjamin A. Gianneschi, Irvine, CA (US); Nancy Lu, Irvine, CA (US); Joe Hsu, Irvine, CA (US)

(73) Assignee: Scholle Corporation, Irvine, CA (US)

( * ) Notice: Subject to any disclaimer, the term of this patent is extended or adjusted under 35 U.S.C. 154(b) by 0 days.

(21) Appl. No.: 10/361,139

(22) Filed: Feb. 7, 2003

(65) Prior Publication Data

US 2003/0147568 A1 Aug. 7, 2003

Related U.S. Application Data

(60) Provisional application No. 60/355,045, filed on Feb. 7, 2002.

(51) Int. Cl.[7] ..... B65D 33/02

(52) U.S. Cl. ..... 383/119; 383/104; 383/903; 222/105

(58) Field of Search ..... 383/119, 104–105, 383/122, 903, 3, 107; 222/105

(56) References Cited

U.S. PATENT DOCUMENTS

| | | | | |
|---|---|---|---|---|
| 2,370,226 A | | 2/1945 | Brede et al. | |
| 3,051,366 A | | 8/1962 | Schneider et al. | |
| 3,173,602 A | * | 3/1965 | Clipner | 383/37 |
| 3,294,227 A | * | 12/1966 | Schneider et al. | 206/219 |
| 3,380,646 A | | 4/1968 | Doyen et al. | |
| 3,437,258 A | | 4/1969 | Kugler | |
| 3,502,521 A | | 3/1970 | Doyen et al. | |
| 3,690,545 A | | 9/1972 | Piazza | |
| 3,719,318 A | | 3/1973 | Moran | |
| 3,949,901 A | | 4/1976 | Tokita | |
| 4,019,635 A | | 4/1977 | Boots | |
| 4,041,851 A | | 8/1977 | Jentsch | |
| 4,082,216 A | * | 4/1978 | Clarke | 229/164.1 |
| 4,312,473 A | * | 1/1982 | Hoeller | 383/38 |
| 4,413,771 A | * | 11/1983 | Rohde et al. | 494/17 |
| 4,450,581 A | | 5/1984 | Hirata | |
| 4,542,530 A | | 9/1985 | Thomas et al. | |
| 4,622,693 A | | 11/1986 | Mykleby | |
| 4,669,124 A | | 5/1987 | Kimura | |
| 4,721,396 A | | 1/1988 | Sengewald | |
| 4,809,352 A | * | 2/1989 | Walker | 383/3 |
| 4,834,255 A | | 5/1989 | Boots | |
| 4,840,017 A | | 6/1989 | Miller et al. | |
| 4,887,912 A | | 12/1989 | Stumpf | |
| 4,901,885 A | | 2/1990 | Boots | |
| 4,927,037 A | | 5/1990 | Boots | |
| 4,978,025 A | | 12/1990 | Fougeres | |
| 5,028,147 A | | 7/1991 | Graham | |
| 5,052,579 A | | 10/1991 | Boots | |
| 5,062,717 A | | 11/1991 | Shockley | |
| 5,195,829 A | | 3/1993 | Watkins et al. | |
| 5,219,220 A | | 6/1993 | Kucera et al. | |
| 5,282,544 A | | 2/1994 | Boots | |
| 5,289,937 A | | 3/1994 | Boots | |
| 5,307,955 A | | 5/1994 | Viegas | |
| 5,350,240 A | | 9/1994 | Billman et al. | |
| 5,407,090 A | | 4/1995 | Boots | |
| 5,452,844 A | | 9/1995 | Bochet et al. | |
| 5,547,284 A | | 8/1996 | Imer | |
| 5,755,514 A | | 5/1998 | Baar-Bartelt | |

(Continued)

FOREIGN PATENT DOCUMENTS

DE 41 15 345 A1 11/1992

*Primary Examiner*—Jes F. Pascua
(74) *Attorney, Agent, or Firm*—King & Javanovic, PLC

(57) ABSTRACT

An internal brace for use in association with a flexible container having at least one wall defining an inner cavity. The internal brace comprises a body and an attachment assembly. The body includes a first surface, a second surface, opposite the first surface and opposing ends. The attachment assembly is associated with the opposing ends of the body. The attachment assembly facilitates the attachment of the opposing ends of the body to the at least one wall within the inner cavity.

22 Claims, 5 Drawing Sheets

U.S. PATENT DOCUMENTS 5,788,121 A 8/1998 Sasaki et al.
5,836,696 A 11/1998 Schnell
6,036,365 A 3/2000 Imer
6,046,443 A 4/2000 Ackerman et al.
6,076,968 A 6/2000 Smith et al.
6,092,933 A 7/2000 Treu
6,095,688 A 8/2000 Nittel et al.
6,116,781 A 9/2000 Skeens
6,126,315 A 10/2000 Ichikawa et al.
6,139,187 A 10/2000 Galomb et al.
6,213,645 B1 4/2001 Beer
6,220,702 B1 4/2001 Nakamura et al.
6,409,386 B1 6/2002 Trani et al.
6,695,757 B2 * 2/2004 Edwards et al. ..... 493/51

* cited by examiner

INTERNAL BRACE FOR A STANDUP FLEXIBLE CONTAINER

CROSS-REFERENCE TO RELATED APPLICATION

This application claims the priority of U.S. Provisional Patent Application Ser. No. 60/355,045 filed Feb. 7, 2002 entitled "Internal Brace For Standup Bag." Additionally, this application is related to U.S. Provisional Patent Application Ser. No. 60/261,597 filed Jan. 12, 2001, U.S. Provisional Patent Application Ser. No. 60/300,623 filed Jun. 25, 2001, U.S. Provisional Patent Application Ser. No. 60/305,788 filed Jul. 16, 2001, and U.S. Provisional Patent Application Ser. No. 60/311,774 filed Aug. 10, 2001. In addition, this application is related to U.S. patent application Ser. No. 10/029,513 filed Dec. 20, 2001, now, U.S. Pat. No. 6,746, 388 B2, U.S. patent application Ser. No. 10/029,604 filed Dec. 20, 2001, abandoned, U.S. patent application Ser. No. 10/029,695 filed Dec. 20, 2001, now, U.S. Pat. No. 6,695, 757 B2, and U.S. patent application Ser. No. 10/029,696 filed Dec. 20, 2001, now U.S. Pat. No. 6,783,277 B2. In addition, this application is related to PCT Patent Application Serial No. PCT/US02/00815 filed Jan. 11, 2002. The entire disclosure of each of the above-identified priority and related applications is hereby incorporated herein by reference.

BACKGROUND OF THE INVENTION

1. Field of the Invention

The present invention relates in general to flexible containers, and, more particularly to an internal brace for use in association with a flexible container which is designed to be articulatable from a collapsed, substantially flat configuration, to a standup filled configuration to facilitate the retention of a desired shape for the container, and to add rigidity to the flexible container.

2. Background Art

Many varieties of flexible containers for flowable materials such as liquids, pastes, granulates, flakes, or powders are known. Flexible containers are advantageous because they can be folded extremely flat in their empty state so as to require very little space. The filling of such flexible containers with the product is generally performed in an automated operation. The flexible container is placed upright with its dispensing opening pointing upwardly to permit a filling nozzle to be inserted thereinto. After the flexible container has been filled, the dispensing opening is closed by welding, sealing, or a closure. Such flexible containers are adaptable for packaging of liquids and dry products and are suitable replacement for other types of packaging such as plastic or glass bottles, cans, and boxes.

While such flexible containers are advantageous, there are nevertheless certain problems which have arisen. For example, it is often desirable to maintain a predetermined shape and to minimize the bulging or distortion of the walls of a flexible container due to the outward force of the flowable material positioned therein. While the heat seals and the shape of the bag substantially constrain the overall shape of the flexible bag, as the wall thicknesses decrease, and as the wall material becomes weaker, the flowable material contained therein can alter or otherwise distort the shape of the container.

Accordingly, it is an object of the invention to substantially minimize the effects of the flowable material on the distortion of the walls of a flexible container.

It is another object of the invention to facilitate the retention of a flexible container in a desired configuration.

It is yet another object of the invention to facilitate the retention of a flexible container in a desired configuration while substantially facilitating the ingress and egress of flowable material from within the flexible container.

These objects as well as other objects of the present invention will become apparent in light of the present specification, claims, and drawings.

SUMMARY OF THE INVENTION

In one aspect of the invention, the invention comprises a flexible container and at least one internal brace. The flexible container includes a plurality of walls. The walls are joined to each other by way of a heat seal, and at least one pair of walls comprises opposing walls. The at least one internal brace includes a body and an attachment assembly. The body includes a first surface, a second surface opposite the first surface and opposing ends. The attachment assembly is associated with the opposing ends of the body. The attachment assembly attaches the opposing ends of the body to opposing walls of the plurality of walls.

In one embodiment, the plurality of walls comprise a front wall, a rear wall, top wall, bottom wall and side walls. In one such embodiment, the opposing walls comprise one of the group consisting of: front wall and rear wall, top wall and bottom wall, side wall and side wall.

In another preferred embodiment, the body of the at least one internal brace further comprises opposing side edges. At least a portion of at least one of the opposing side edges are positionable such that they are spaced apart from any of the plurality of walls by a predetermined distance. In one embodiment, each of the opposing side edges are positionable such that they are spaced apart from any of the plurality of walls by a predetermined distance.

In a preferred embodiment, the at least one internal brace further comprises at least one articulation region facilitating the articulation and collapse of the internal brace.

In another preferred embodiment, the at least one internal brace comprises a plurality of internal braces. In one such embodiment, the plurality of internal braces are positioned so as to be spaced apart from each other in a substantially parallel configuration.

In a preferred embodiment, at least two walls are formed by the heat sealing of edges of at least four separate regions associated with four adjoining walls. Preferably, the heat seals of each of the at least two walls define a central heat seal region having opposing substantially outwardly concave heat seal regions. Additionally, the outwardly concave heat seal cooperates with each of the four adjoining walls to define a corner region.

In another aspect of the invention, the invention comprises an internal brace for use in association with a flexible container having at least one wall defining an inner cavity. The internal brace comprises a body and an attachment assembly. The body includes a first surface, a second surface, opposite the first surface and opposing ends. The attachment assembly is with the opposing ends of the body. The attachment assembly facilitates the attachment of the opposing ends of the body to the at least one wall within the inner cavity.

In a preferred embodiment, the body further comprises opposing side edges. Preferably, the opposing side edges are spaced apart from the at least one wall of the flexible container.

In another embodiment of the invention, the body further includes an articulation region which facilitates the collapse of the body in a predetermined fashion. In one such embodiment, the articulation region comprises a fold extending along the body.

Preferably, the first surface and the second surface are substantially planar, and separated by a substantially uniform distance.

In one preferred embodiment, the body further includes at least one opening extending from the first surface to the second surface.

In another preferred embodiment, the attachment assembly comprises a heat seal. Preferably, the body is substantially rectangular.

BRIEF DESCRIPTION OF THE DRAWINGS

The invention will now be described with reference to the drawings wherein.

DETAILED DESCRIPTION OF THE INVENTION

Figure 1:
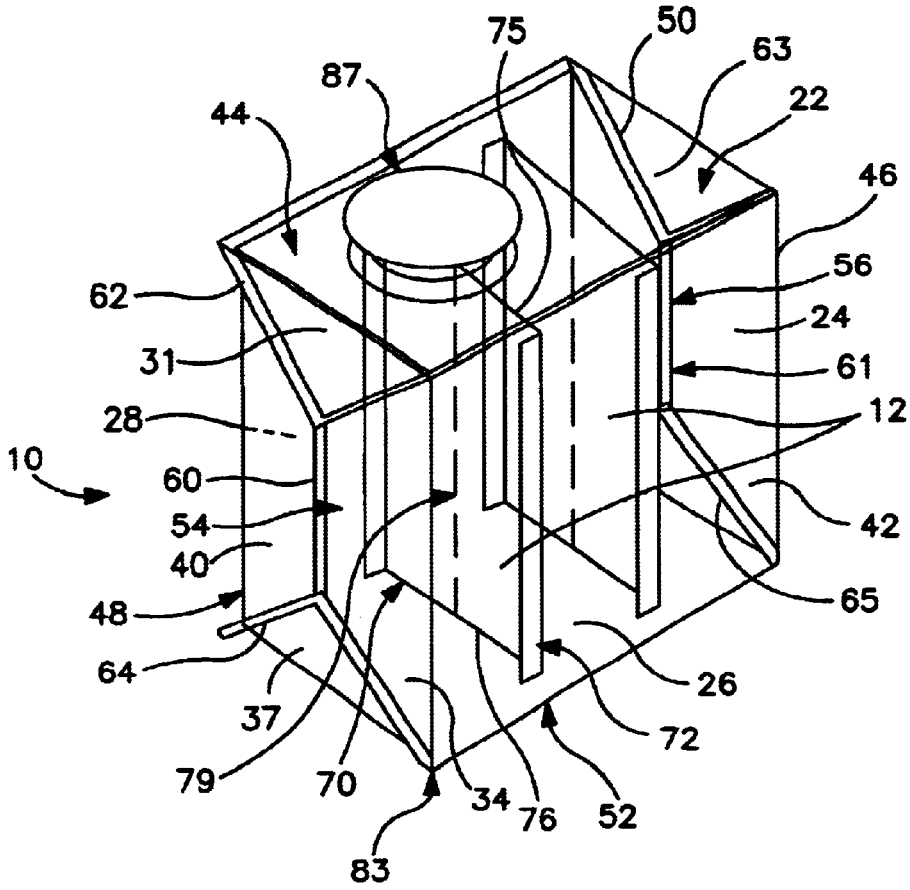
FIG. 1 of the drawings is a perspective view of an internal brace of the present invention showing, in particular, operation thereof within a standup flexible container.

While this invention is susceptible of embodiment in many different forms, there is shown in the drawings and described herein in detail a specific embodiment with the understanding that the present disclosure is to be considered as an exemplification of the principles of the invention and is not intended to limit the invention to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, internal braces such as internal brace 12 for use with flexible container 10 is shown. Flexible container 10 comprises any number of different flexible container configurations, many of which are shown in the related and/or co-pending applications identified above (and sometimes referred to as "standup bag"), as well as in FIGS. 1 through 7. One such flexible container will be described in detail hereinbelow, with the understanding that a number of different containers, such as those identified in the related applications, are likewise contemplated and suitable for use.

As is shown in detail in FIG. 5 below, flexible container 10 is formed from a blank, such as blank 20. Blank 20 includes first panel 22, second panel 24, third panel 26 and fourth panel 28. Blank 20 may comprise a single integrated and substantially planar sheet of material, or, in other embodiments, blank 20 may comprise a plurality of separate panels of material which may be attached together about edges thereof through various means, such as, for example, heat sealing, impulsed sealing, ultrasonic sealing, RF sealing, or other sealing methods known in the art.

In particular, first panel 22 includes central region 30 and opposing wing regions 31, 32. Second panel 24 includes central region 33 and opposing wing regions 34, 35. Third panel 26 includes central region 36 and opposing wing regions 37, 38. Fourth panel 28 includes central region 39 and opposing wing regions 40, 41. In the embodiment shown, each panel 22–28 comprises a integrated panel having three regions, of course, other embodiments are contemplated. As will be explained, the wing regions cooperate to form certain of the walls.

Referring again to FIG. 1, the articulated container is shown as comprising front wall 42, rear wall 44, side walls 46, 48, top wall 50 and bottom wall 52. The walls cooperate to define a variable volume internal cavity. Front wall 42 is formed from central region 33 of second panel 24. Similarly, rear wall 44 is formed from central region 39 of forth panel 28. Top wall 50 is formed from central region 30 of first panel 22. Bottom wall 52 is formed from central region 36 of third panel 26. To achieve same, in addition to the attachment of the panels as shown in FIG. 5, the upper edge of central region 30 of first panel 22 is heat sealed with the lower edge of central region 39 of fourth panel 28.

As is likewise shown in FIG. 1, side wall 48 is formed from a cooperation of the opposing wing regions 31, 34, 37 and 40. In particular, the four panels are joined along the edges thereof to form heat seal 54. Heat seal 54 comprises a central heat seal region 60 and opposing outwardly concave heat seal region 62, 64. While not required, the concave hot seal regions 62, 64 generally each comprise a substantially "v" shaped configuration wherein the vertex of each is associated with an opposing end of the central heat seal region.

Referring again to FIG. 1, side wall 46 is formed from a cooperation of the opposing wing regions 32, 35, 38 and 41. In particular, the four panels are joined along the edges thereof to form heat seal 56. Heat seal 56 comprises a central heat seal region 61 and opposing outwardly concave heat seal regions 63, 65. The concave heat seal regions 63, 65 generally each comprise a substantially "v" shaped configuration wherein the vertex of each is associated with an opposing end of the central heat seal region. Of course, other configurations are likewise contemplated.

From such a construction, a corner structure, such as corner structure 83 is formed proximate the region wherein each of the outwardly concave heat seals 62, 63, 64 and 65 terminate. In turn, and as is explained in detail in the above-incorporated patent specifications, the formation and cooperation of the panels of the blank of the flexible container, and the heat seals thereof, provide substantially flat and stable surfaces that allow the flexible container to stand substantially upright on a level surface, even when only partially filled with the flowable substance.

In the embodiment shown in FIG. 1, a fitment, such as fitment 87 is included in top wall 50. Of course in other embodiments, it is contemplated that any number of different fitments may be positioned in varying positions about the panels or the heat seals thereof. The invention is not limited to any particular fitment, or the particular position of any fitment.

Figure 6A:
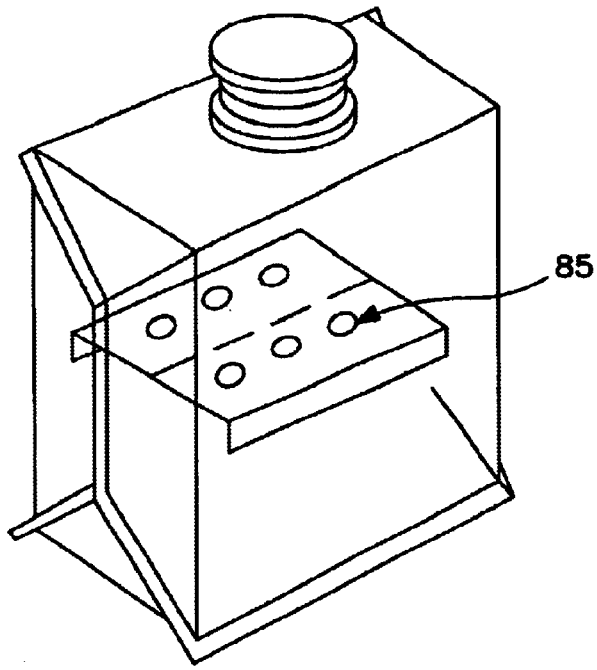
FIGS. 6*a*–6*b* of the drawings is a perspective view of embodiments of an internal brace of the present invention showing, in particular, operation thereof within a standup flexible container.
Figure 6B:
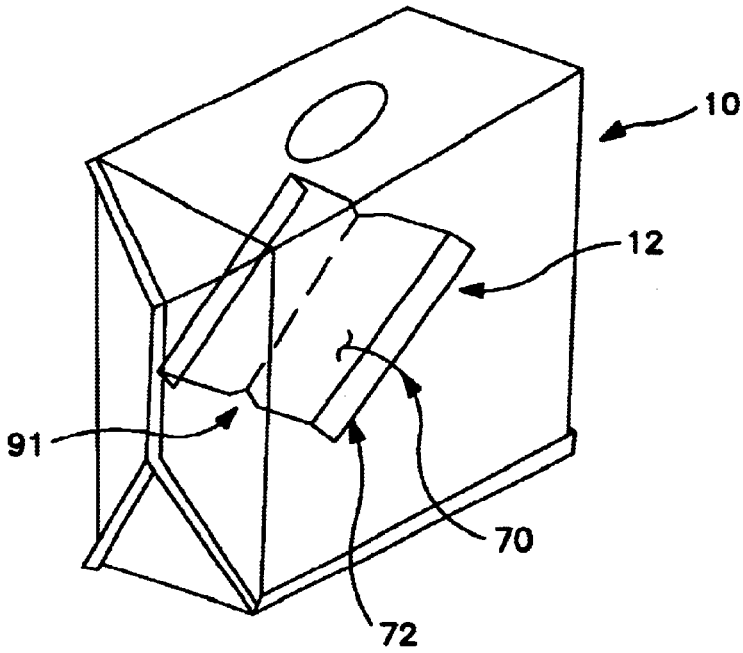
Figure 7A:
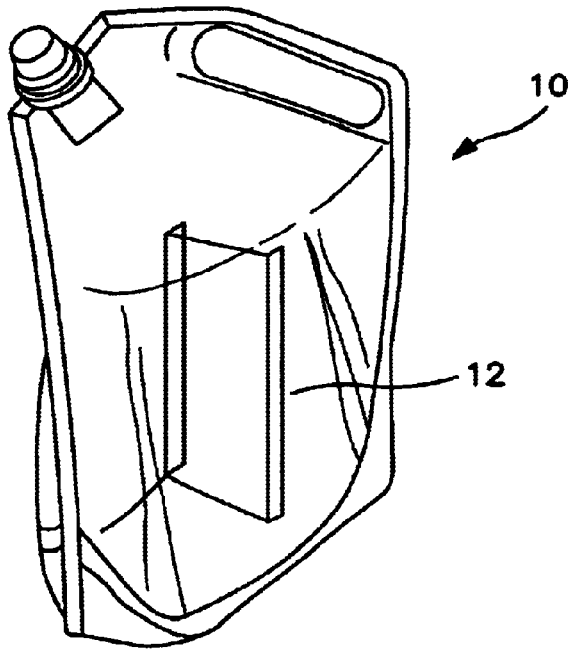
FIGS. 7*a*–7*b* of the drawings are a perspective view of an embodiment of an internal brace of the present invention showing, in particular, operation thereof with a variety of different containers.
Figure 7B:
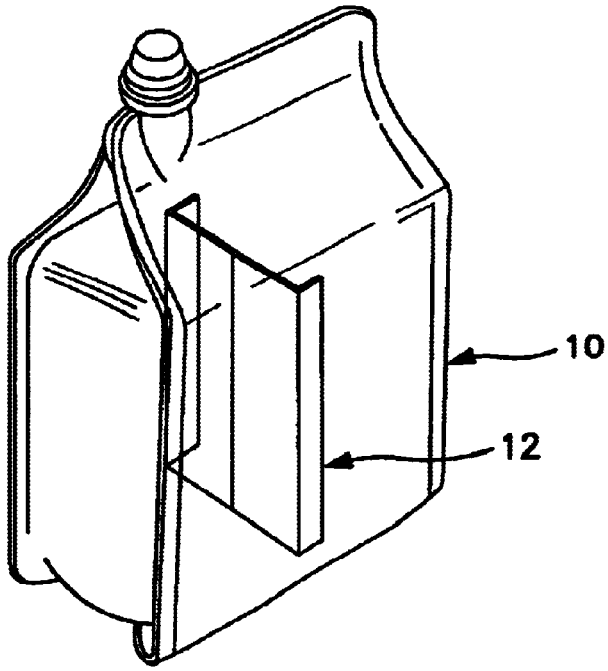

Of course, the flexible container in not limited to the embodiment shown in FIG. 1, or any of the embodiments of FIGS. 6 and 7. Indeed, any number of different constructions are contemplated for the flexible container of the present invention (i.e., at least one wall defining an inner cavity). As explained above, such containers may be manufactured in accordance with the above-incorporated patent applications, as well as designs which are related thereto.

Internal braces, such as internal brace 12, is shown in FIG. 1 as comprising body 70 and attachment assembly 72. It will be understood that while a plurality of internal braces are shown, internal brace 12 will be explained in detail with the understanding that the other internal brace is substantially identical. Moreover, it will be understood that, while two braces are shown, it is contemplated that a greater or fewer number of braces may be utilized in a particular embodiment, depending on the desired use of same.

Figure 2:
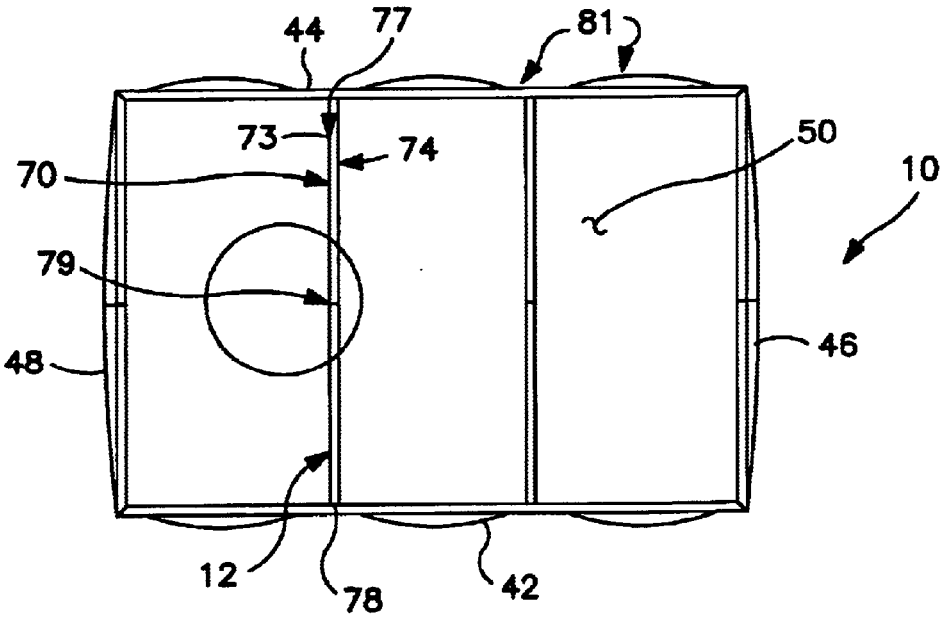
FIG. 2 of the drawings is a top plan view of an internal brace of the present invention showing, in particular, corrugations formed by the fluid force against the side walls.

Referring to FIG. 2, body 70 includes first surface 73, second surface 74, opposing side edges 75, 76 (FIG. 1) and opposing ends 77,78. Body 70 is substantially planar such that top surface 73 and bottom surface 74 are substantially parallel to each other, and separated by the substantially uniform thickness of body 70. Of course, it is contemplated that the first and second surfaces may be non-uniform (i.e., non-planar, or inclusive of varying surface configurations and topographies), and that the first and second surfaces may be at varying relationships with each other (i.e., the thickness of body 70 may be substantially non-uniform).

Additionally, body 70 is, in the embodiment shown, substantially rectangular, such that the opposing side edges are substantially parallel and such that the opposing ends are substantially parallel. Moreover, in such a configuration, the side edges and ends are substantially perpendicular. Of course, it is contemplated that the ends and the side edges may have varying and non-linear configurations having a variety of relationships and orientations relative to each other.

Figure 3:
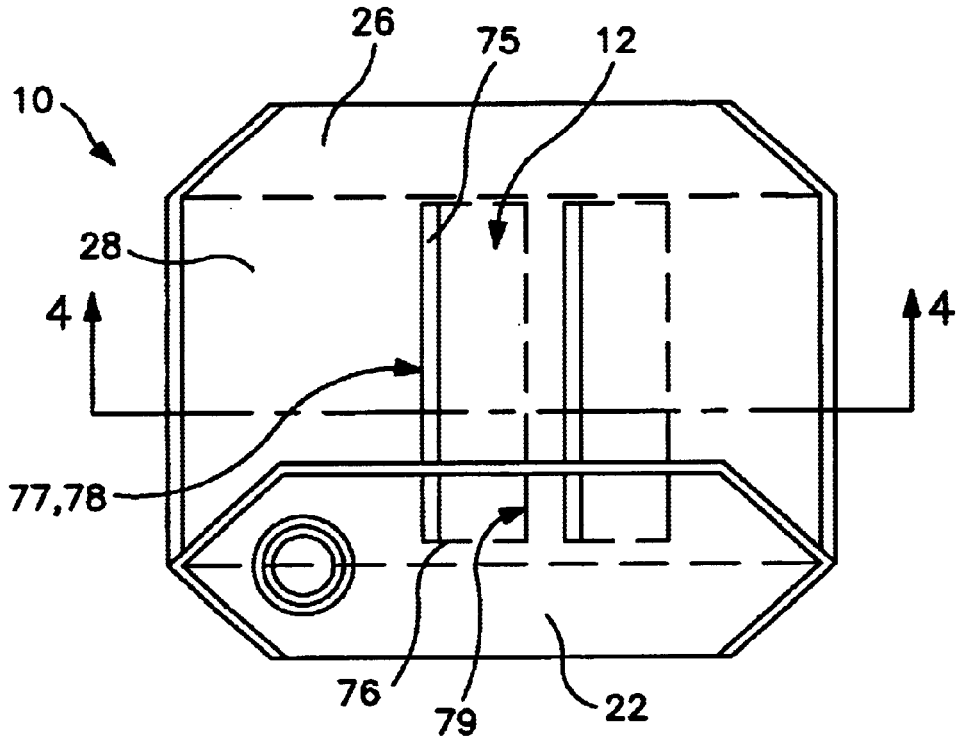
FIG. 3 of the drawings is a side elevational view of the internal brace of the present invention showing, in particular, operation thereof in a collapsed position.
Figure 4:
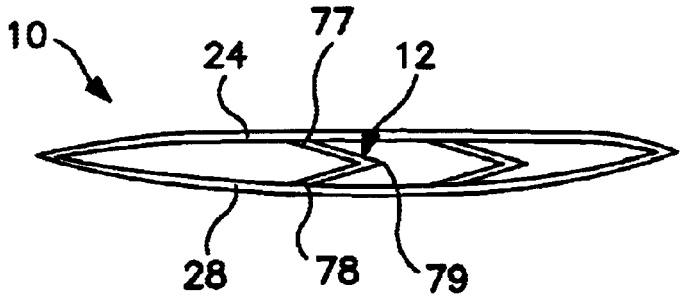
FIG. 4 of the drawings is a cross-sectional view of the internal brace of the present invention taken generally about line 4—4 of FIG. 3 showing, in particular, the internal brace in a collapsed configuration.

Referring now to FIGS. 1, 3 and 4, to facilitate collapsing and articulation of body 70, body 70 may further include articulation region 79. In one embodiment, articulation region 79 comprises a fold line which facilitates the controlled articulation and collapse of body 70 therealong. In other embodiments, such as the embodiment shown in FIG. 6*b*, articulation region 79 may comprise altered dimension 91 (i.e., variation in the side edges or the distance between the side edges, or a variation in thickness, among others) which facilitates the controlled articulation and/or collapse of body 70. Additionally, while articulation region 79 is shown as comprising a single fold, it is contemplated that articulation region 79 may comprise a plurality of interrelated structures (i.e., multiple folds, or multiple above-described altered regions).

Attachment assembly 72 is shown in FIG. 2 as comprising a heat seal sealing at least a portion of opposing ends 77, 78 to various walls of flexible container 10 (i.e., opposing walls, among others). In particular, end 78 is attached to front wall 42 and end 77 is attached to rear wall 44. Of course, it is contemplated that the internal brace may be attached to any one of the side walls, the front wall, the rear wall, the top wall and the bottom wall. In the embodiment shown, body 70 is shorter than the height of front and rear walls 42, 44, such that a passage is maintained for the flowable material between side edges 75, 76 of body 70 and each of top wall 50 and bottom wall 52. Furthermore, with reference to FIG. 6, it is contemplated that, in certain embodiments, body 70 may have openings, such as opening 85, extending therethrough to facilitate the passage of flowable material beyond the body.

Additionally, body 70 is positioned in an orientation which is substantially perpendicular to top wall 50 and bottom wall 52 and substantially perpendicular to front and rear walls 42, 44, respectively. Additionally, body 70 is substantially parallel with side walls 46, 48. In other embodiments it is contemplated that the body 70 may be disposed horizontally, wherein the body is substantially perpendicular to each of front wall 42, rear wall 44, perpendicular to side walls 46, 48 and parallel to top wall 50 and bottom wall 52.

Of course, body 70 is not limited to parallel and perpendicular relationships with the walls of the flexible container. Indeed, it is likewise contemplated that body 70 may be positioned in a number of different orientations so as to achieve the desired internal bracing of the flexible container. For example, body 70 may be positioned so that it is disposed oblique to any one or more of the front wall, rear wall, side walls, top wall and bottom wall.

With particular reference to FIG. 2, the distance between the opposing ends 77, 78 of body 70 can be configured relative to the top wall, the bottom wall and the side walls such that the flowable material positioned within the container creates an outward force against the front and back wall so as to produce bulges or corrugations, such as corrugations 81. In certain embodiments, when placed side by side with other containers, the corrugations provide a passageway for air circulation. This is highly advantageous wherein the containers are refrigerated.

Figure 5:
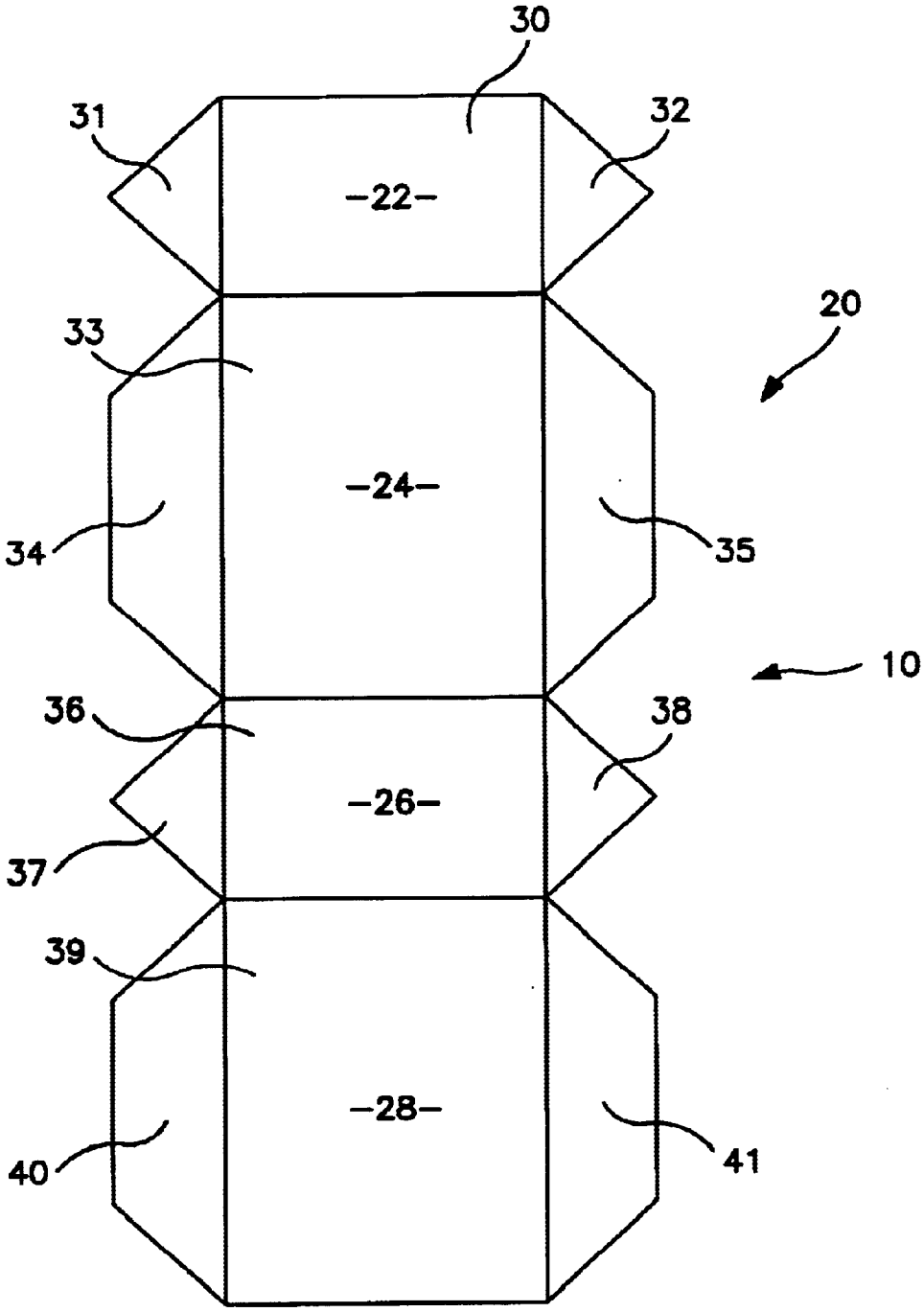
FIG. 5 of the drawings is a top plan view of a blank of an exemplary standup flexible container with which the internal brace of the present invention may be utilized.

In operation, as is shown in FIG. 5, a suitable blank is provided. The blank is then heat sealed into a desired configuration. Prior to the completion of the heat sealing of the various panels of the blank, an internal brace is positioned as desired and heat sealed to the appropriate walls.

Once complete, the container is collapsed into a non-articulated configuration. In particular, a collapsed configuration is shown in FIGS. 3 and 4. In such a configuration, the front wall and the rear wall substantially abut each other. In addition, the internal brace is collapsed about articulation region 79 such that the opposing ends of the body are in substantial abutment. In turn, the flexible container is in a substantially flat configuration.

As the container is filled with a flowable material, the assembly begins to articulate. Specifically, the side walls begin to form and the resulting corners become formed. The container, in turn, assumes a substantially cubical configuration. To further facilitate the cubical configuration, internal brace 12 facilitates the maintenance of such a desired shape by countering the outward force of the fluid acting upon the side walls and the front and rear walls. In particular, proximate the internal braces, the front and rear walls of the container (or any walls to which the internal brace is attached) are maintained a predetermined distance from each other.

Inasmuch as the internal brace does not extend the full length of a corresponding wall, and, may optionally include openings therein, the internal brace does not substantially preclude the passage or the flow of flowable material positioned within the flexible container.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A flexible container comprising:

a plurality of walls, including front wall, a rear wall, top wall, bottom wall and side walls, the walls being joined to each other by way of a heat seal, at least one pair of walls comprising opposing walls, the plurality of walls defining a sealable cavity capable of receiving a flowable material for dispensing;

a fitment providing fluid communication with the cavity; and at least one internal brace positioned within the cavity such that the fitment maintains fluid communication with the entirety of the cavity, the at least one internal brace including:

a body having a first surface, a second surface opposite the first surface and opposing ends; and an attachment assembly associated with the opposing ends of the body, wherein the attachment assembly attaches the opposing ends of the body to opposing walls of the plurality of walls, to substantially facilitate the reinforcement of the flexible container when filled with a flowable material.

2. The flexible container of claim 1 wherein the opposing walls comprise one of the group consisting of: front wall and rear wall, top wall and bottom wall, side wall and side wall.

3. The flexible container of claim 1 wherein the body of the at least one internal brace further comprises opposing side edges, at least a portion of at least one of the opposing side edges are positionable such that they are spaced apart from any of the plurality of walls by a predetermined distance.

4. The flexible container of claim 3 wherein each of the opposing side edges are positionable such that they are spaced apart from any of the plurality of walls by a predetermined distance.

5. The flexible container of claim 1 wherein the at least one internal brace further comprises at least one articulation region facilitating the articulation and collapse of the internal brace.

6. The flexible container of claim 1 wherein the at least one internal brace comprises a plurality of internal braces.

7. The flexible container of claim 6 wherein the plurality of internal braces are positioned so as to be spaced apart from each other in a substantially parallel configuration.

8. The flexible container of claim 1 wherein at least two walls are formed by the heat sealing of edges of at least four separate regions associated with four adjoining walls.

9. The flexible container of claim 1 wherein the body includes a plurality of openings extending through the first and second surfaces thereof, so as to facilitate the passage of flowable material beyond the body.

10. The flexible container of claim 1 wherein the body extends substantially oblique relative to the wall in which the fitment is positioned.

11. The flexible container of claim 1 wherein the body extends substantially perpendicular to the wall in which the fitment is positioned.

12. A flexible container comprising:

a plurality of walls, the walls being joined to each other by way of a heat seal, at least one pair of walls comprising opposing walls, the plurality of walls defining a sealable cavity capable of receiving a flowable material for dispensing;

a fitment providing fluid communication with the cavity; and a plurality of internal braces positioned within the cavity so as to be spaced apart from each other in a substantially parallel configuration and positioned such that the fitment maintains fluid communication with the entirety of the cavity, each of the plurality of internal braces including:

a body having a first surface, a second surface opposite the first surface and opposing ends; and an attachment assembly associated with the opposing ends of the body, wherein the attachment assembly attaches the opposing ends of the body to opposing walls of the plurality of walls, to substantially facilitate the reinforcement of the flexible container when filled with a flowable material.

13. The flexible container of claim 12 wherein the body of the at least one internal brace further comprises opposing side edges, at least a portion of at least one of the opposing side edges are positionable such that they are spaced apart from any of the plurality of walls by a predetermined distance.

14. The flexible container of claim 12 wherein at least two walls are formed by the heat sealing of edges of at least four separate regions associated with four adjoining walls.

15. The flexible container of claim 2 wherein the body extends substantially oblique relative to the wall in which the fitment is positioned.

16. A flexible container comprising:

a plurality of walls, the walls being joined to each other by way of a heat seal, at least one pair of walls comprising opposing walls, the plurality of walls defining a sealable cavity capable of receiving a flowable material for dispensing, at least two walls are formed by the heat sealing of edges of at least four separate regions associated with four adjoining walls;

a fitment providing fluid communication with the cavity; and at least one internal brace positioned within the cavity such that the fitment maintains fluid communication with the entirety of the cavity, the at least one internal brace including:

a body having a first surface, a second surface opposite the first surface and opposing ends; and an attachment assembly associated with the opposing ends of the body, wherein the attachment assembly attaches the opposing ends of the body to opposing walls of the plurality of walls, to substantially facilitate the reinforcement of the flexible container when filled with a flowable material.

17. The flexible container of claim 16 wherein the heat seals of each of the at least two walls define a central heat seal region having opposing substantially outwardly concave heat seal regions.

18. The flexible container of claim 17 wherein the outwardly concave heat seal cooperates with each of the four adjoining walls to define a corner region.

19. The flexible container of claim 18 wherein the at least one internal brace further comprises at least one articulation region facilitating the articulation and collapse of the at least one internal brace.

20. The flexible container of claim 18 wherein the at least one internal brace comprises a plurality of internal braces.

21. The flexible container of claim 16 wherein the body includes a plurality of openings extending through the first and second surfaces thereof, so as to facilitate the passage of flowable material beyond the body.

22. A flexible container comprising:

a plurality of walls, the walls being joined to each other by way of a heat seal, at least one pair of walls comprising opposing walls, the plurality of walls defining a sealable cavity capable of receiving a flowable material for dispensing;

a fitment providing fluid communication with the cavity; and at least one internal brace positioned within the cavity such that the fitment maintains fluid communication with the entirety of the cavity, the at least one internal brace including:

a body having a first surface, a second surface opposite the first surface, opposing ends and a plurality of openings extending through the first and second surfaces thereof, so as to facilitate the passage of flowable material beyond the body; and an attachment assembly associated with the opposing ends of the body, wherein the attachment assembly attaches the opposing ends of the body to opposing walls of the plurality of walls, to substantially facilitate the reinforcement of the flexible container when filled with a flowable material.

* * * * *

UNITED STATES PATENT AND TRADEMARK OFFICE

CERTIFICATE OF CORRECTION

PATENT NO. : 6,921,204 B2
DATED : July 26, 2005
INVENTOR(S) : Edwards et al.

It is certified that error appears in the above-identified patent and that said Letters Patent is hereby corrected as shown below:

Title page,
Item [56], References Cited, U.S. PATENT DOCUMENTS, delete "3,051,366 A" and substitute -- 3,051,368 A --; and delete "3,690,545 A 9/1972 Piazza" and substitute -- 3,690,545 A 9/1972 Piazze --.
Item [74], *Attorney, Agent, or Firm*, delete "King & Javanovic, PLC" and substitute -- King & Jovanovic, PLC --.

Column 4,
Line 33, delete "of forth panel" and substitute -- of fourth panel --.
Line 46, delete "hot seal regions" and substitute -- heat seal regions --.

Column 5,
Line 10, delete "container in not" and substitute -- container is not --.

Column 8,
Line 32, delete "container of claim 2" and substitute -- container of claim 12 --.

Signed and Sealed this

Eighteenth Day of October, 2005

JON W. DUDAS
*Director of the United States Patent and Trademark Office*